US006780256B2

(12) United States Patent
Rivera

(10) Patent No.: US 6,780,256 B2
(45) **Date of Patent: *Aug. 24, 2004**

(54) METHOD OF TREATING A METAL SURFACE WITH A NO RINSE ZINC PHOSPHATE COATING

(75) Inventor: José B. Rivera, Philadelphia, PA (US)

(73) Assignee: Bulk Chemicals, Inc., Reading, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/228,446

(22) Filed: Aug. 27, 2002

(65) Prior Publication Data

US 2003/0029524 A1 Feb. 13, 2003

Related U.S. Application Data

(60) Division of application No. 09/657,847, filed on Sep. 8, 2000, now abandoned, which is a continuation-in-part of application No. 09/275,586, filed on Mar. 24, 1999, now Pat. No. 6,117,251.

(51) Int. Cl.[7] ..... C23C 22/07

(52) U.S. Cl. ..... 148/259; 148/261; 148/262; 148/283; 106/14.12; 106/14.13; 252/389.23

(58) Field of Search ..... 148/250, 259, 148/261, 262, 283; 106/14.12, 14.13; 252/389.23

(56) References Cited

U.S. PATENT DOCUMENTS

| | | | | |
|---|---|---|---|---|
| 3,939,014 | A | | 2/1976 | Reed |
| 4,053,328 | A | | 10/1977 | Oka et al. |
| 4,338,141 | A | | 7/1982 | Senzaki et al. |
| 4,427,459 | A | | 1/1984 | Goltz |
| 4,659,395 | A | | 4/1987 | Sugama et al. |
| 5,261,973 | A | | 11/1993 | Sienkowski et al. |
| 5,378,292 | A | | 1/1995 | Miller et al. |
| 6,117,251 | A | * | 9/2000 | Rivera ..... 148/251 |

OTHER PUBLICATIONS

Sugama, T.; Kukacka, L.E.; Carciello, N.; and Warren, J.B., "Use of Polyacrylic Acid Electrolytes Diffused in Zinc Phosphate Conversion Coatings For the Corrosion Protection of Steel," *Journal of Coatings Technology*, vol. 61, No. 771, Apr. 1989, pp. 43–57.

Kunde, N.D.; Michael, G.M.; and Payer, J.H., "Performance Evaluation of Prephosphated Galvannealed Steel Sheet for Automotive Applications," SAE Technical Paper Series 970152, 1997, pp. 21–26.

Lautensleger, R.W. and Davidson, D.D., "Formability Performance of Prephosphated Galvannealed Sheet Steel," SAE Technical Paper Series 970717, 1997, pp. 148–158.

* cited by examiner

*Primary Examiner*—Andrew L. Oltmans
(74) *Attorney, Agent, or Firm*—RatnerPrestia

(57) ABSTRACT

An aqueous solution and method for applying the solution to a metal surface form a zinc phosphate coating on the metal surface. The zinc phosphate coating minimizes corrosion and improves adhesion of subsequently coated materials such as sealants and paints. The solution of the composition and method of application consume free acidity otherwise left on the metal surface, and obviate the need for subsequent rinsing or extensive drying or stoving operations. The composition includes an aqueous solution including water, a zinc source, phosphoric acid, a polyhydric compound (preferably pentaerythritol), a metal salt, and optionally, an oxidizer.

9 Claims, No Drawings

METHOD OF TREATING A METAL SURFACE WITH A NO RINSE ZINC PHOSPHATE COATING

CROSS-REFERENCE TO RELATED APPLICATION

The present application is a divisional of U.S. patent application Ser. No. 09/657,847, filed on Sep. 8, 2000 now abandoned which is a continuation-in-part of U.S. patent application Ser. No. 09/275,586, filed on Mar. 24, 1999, which issued on Sep. 12, 2000, as U.S. Pat. No. 6,117,251.

BACKGROUND OF THE INVENTION

The present invention relates to an aqueous composition for forming zinc phosphate coatings on metal surfaces. When a metal surface is formed, it requires treatment for corrosion resistance and may also require a pre-treatment prior to sealing and/or painting. Zinc phosphate coating solutions are commonly known in the art to pretreat metal surfaces prior to sealing and/or painting. Zinc phosphate coatings isolate corrosion sites. The morphology of the zinc phosphate provides physical anchoring sites for sealing and/or painting solutions which may be applied to the surface in subsequent processing. Zinc phosphate coatings have been successfully used for years to improve the adhesion of paint and other finishes to metal surfaces and to achieve superior corrosion resistance with these finishes.

The drawbacks associated with the application of a zinc phosphate coating solution include the additional process steps which are required in its application. The additional process steps include rinsing and heating the surface after application of the zinc phosphate solution. The rinsing and heating or stoving processes may require a considerable amount of time. The costs associated with these processes include the cost for water rinsing, the disposal of the waste produced after the rinsing process, the equipment and gases and exhaust system used in the heating process, and the processing time used for rinsing and stoving or drying.

The prior art includes solutions and methods for reducing the additional steps associated with the phosphating process and the costs associated with these processes. For example, U.S. Pat. No. 4,659,395 to Sugama et al., provides a process for applying a zinc phosphating solution which does not require subsequent rinsing. However, the prior art of Sugama et al. does require a stoving process to dry the zinc phosphating solution from the surface being treated. The stoving, or other lengthy heating process necessary for curing the surface, is time consuming. This is especially undesirable where the metal surface is produced in a continuous process whereby a metal sheet is continuously painted at speeds of up to 300 feet per minute (or even higher), and must be wound into a coil for storage soon after being produced. In this dynamic processing mode, the metal surface must be treated as it is being produced and before it is rolled into a coil. Therefore, it can be seen that despite advances in the prior art such as those by Sugama et al., a zinc phosphate coating solution which requires neither a rinsing process, nor an extended stoving process for drying, is still lacking in the art.

U.S. patent application Ser. No. 09/275,586, the parent of this application and owned by the assignee hereof, is directed to the use of polyvinyl alcohol, along with zinc oxide, phosphoric acid, and a metal salt in an aqueous solution. Although this composition offers advantages, it has been found that, in some situations, the presence of polyvinyl alcohol tends to cause foaming, solubility problems, and causes the coating to be too tacky.

It is a goal of the present invention to provide a zinc phosphate coating solution which is capable of providing desired adhesion and corrosion resistance qualities by effectively pretreating a metal surface without requiring any additional process operations directed to rinsing or stoving the treated surface.

SUMMARY OF THE INVENTION

To achieve these and other objects, and in view of its purposes, the present invention provides a composition and method for forming a zinc phosphate coating on a metal surface. The present invention also provides a method for producing a zinc phosphate solution to be used for pretreating metal surfaces. The zinc phosphate solution is an aqueous solution including water, a zinc source, phosphoric acid, a polyhydric compound, a metal salt, and optionally, an oxidizer. The solution may be formed by mixing water, a zinc source, phosphoric acid, a polyhydric compound, a metal salt, and optionally, an oxidizer. In the solution, at least some of the zinc source and at least some of the phosphoric acid react to form zinc dihydrogen phosphate. Once formed, the zinc dihydrogen phosphate complexes with the metal surface to improve the adhesion of subsequently coated films. It is believed that at least some of the polyhydric compound and at least some of the phosphoric acid react to form a polyhydric phosphate ester upon drying.

The method for forming the phosphate coating involves contacting the metal surface with the solution of the present invention under process conditions such that a zinc phosphate coating is formed on the metal surface. The process sequence for treating the metal surface according to the present invention, includes cleaning the metal surface, rinsing the surface, optionally activating the surface, treating the surface with the zinc phosphate solution of the present invention, mechanically removing the excess solution from the surface, optionally sealing, and painting the surface. The solution of the present invention may be applied to the metal surface by any suitable method. The distinctive advantage of the present invention is that rinsing is not required after application of the phosphate solution as in most phosphate pre-paint pretreatments, nor is an extensive stoving process required.

It is to be understood that both the foregoing general description and the following detailed description are exemplary, but not restrictive, of the invention.

DETAILED DESCRIPTION OF THE INVENTION

The entire disclosure of U.S. patent application Ser. No. 09/657,847, filed Sep. 8, 2000, is expressly incorporated by reference herein.

The method and composition of the present invention provide a solution for depositing a zinc phosphate coating on a metal surface which serves as a pretreatment for improving the adhesion of subsequently applied decorative coatings such as paint or other sealants, and which also improves the corrosion resistance of the metal surface. The present invention may be used on a wide variety of metal surfaces, including, but not limited to ferrous or zinc ferrous steel surfaces and aluminum surfaces.

Composition/Method of Formation of the Solution

The composition of the present invention is an aqueous solution including water, a zinc source, phosphoric acid, a polyhydric compound, and a metal salt. Deionized water is used in the preferred embodiment. The zinc source may be zinc dihydrogen phosphate or may react with phosphoric acid to form zinc dihydrogen phosphate, which complexes with the metal surface. Upon drying on the metal surface, it is believed that at least some of the polyhydric/compound and at least some of the phosphoric acid react to form a polyhydric phosphate ester. At any rate, the acidity of the final coating is reduced by the inclusion of the polyhydric compound.

The aqueous solution may be prepared by mixing the following ingredients: water (preferably deionized water); a zinc source; phosphoric acid; a polyhydric compound; and a metal salt. The zinc source may be zinc oxide, at least some of which reacts with at least some of the phosphoric acid upon mixing to produce zinc dihydrogen phosphate. In a preferred embodiment, the solution may be formed by additionally mixing an oxidizer, such as hydrogen peroxide.

Although the solution is described above in terms of the constituents mixed together to form the solution, any method for forming an aqueous zinc dihydrogen phosphate solution containing the above additives of a polyhydric compound and a metal salt, etc, may be used. The present invention is not intended to be limited to forming the zinc dihydrogen solution by mixing zinc oxide and phosphoric acid.

As used herein, the term "zinc source" refers to any compound which provides zinc cations for use in a zinc phosphate coating composition of the present invention. A well-known zinc source for use in such coatings is zinc oxide. When zinc oxide is selected as the zinc source, it is believed that zinc oxide reacts with phosphoric acid to form zinc dihydrogen phosphate. Alternatively, zinc dihydrogen phosphate itself may be used as the zinc source. Elemental zinc may also be used, by being dissolved in phosphoric acid.

As used herein, the term "polyhydric compound" refers to any linear, branched, homocyclic, or non-oxygen heterocyclic organic compound which includes two or more hydroxyl groups. Preferably, the polyhydric compound tends to undergo some reaction with phosphoric acid to form a polyhydric phosphate ester, is soluble or dispersible in water, and does not cause excessive foaming, but does not cause the coating too become too tacky. Exemplary linear polyhydric compounds which are suitable for the present invention include glycerol, diglycerol, gluconic acid, or mannitol. Exemplary branched polyhydric compounds which are suitable for the present invention include pentaerythritol and neopentyl glycol. Exemplary homocyclic polyhydric compounds (i.e., compounds containing only carbon in the ring structure) which are suitable for the present invention include dihydroxy cyclohexane or trihydroxy cyclohexane. Exemplary non-oxygen heterocyclic polyhydric compounds (i.e., compounds containing carbon and at least one other atom but excluding oxygen in the ring structure) which are suitable for the present invention include pyrroles. Preferably, the polyhydric compound is branched and, more preferably, it is pentaerythritol. Optionally, the polyhydric compound selected according to this invention may exclude polyvinyl alcohol.

A number of known metal salts typically used in zinc phosphate coating compositions may be used. These metal salts include nickel nitrate, stannous nitrate, calcium nitrate, and ferric nitrate, among others. In a preferred embodiment, the metal salt is cobalt nitrate hexahydrate.

In a preferred embodiment, an oxidizer is used. An oxidizer is advantageous when the method by which the zinc phosphate coating is applied allows for a relatively short contact time, such as about 2 seconds or less. These well-known methods include spray squeegee, roll coating, dip squeegee, and flood squeegee. In these methods, an oxidizer is often needed to accelerate the reaction. On the other hand, when the method used allows for a longer contact time, such as between 5 and 15 seconds to a minute or longer, an oxidizer is often not needed, although still may be used. In these cases, more time is allowed for the reaction to approach completion. These well-known methods include atomizing immersion and flow coating. Exemplary oxidizers include hydrogen peroxide, tert-butyl peroxide, nitrite, oximes, hydroxylamines, and nitrate. Preferably, the oxidizer also minimizes the formation of hydrogen gas. For example, hydrogen peroxide consumes electrons which minimizes the formation of hydrogen.

The components of the zinc phosphate solution of the present invention can either be added individually or premixed in any combination and may be dissolved in water either before or after addition. In a preferred embodiment, the zinc dihydrogen phosphate solution of the present invention may be formed by intermixing the above ingredients. It is believed that the order of addition is not important in preparing the various zinc dihydrogen phosphate solutions covered by the present invention. The components may be added in any known forms. The aqueous composition is generally produced by the reaction of zinc oxide dispersed in water, with phosphoric acid as will be discussed below. The reaction is exothermic and requires time to cool and completely solubilize.

The intermixing of the zinc oxide with the phosphoric acid within the aqueous solution may be done at the same time or prior to the addition of the other components. In an alternate embodiment, a premixed solution of zinc dihydrogen phosphate may be used. It can be seen that the mixing sequence and procedure is not critical to the present invention. For example, in a preferred embodiment, the polyhydric compound may be directly added to the zinc dihydrogen phosphate solution prior to the time of surface treatment. In an alternative embodiment, a separately formed polyhydric compound solution may be added to the zinc dihydrogen phosphate solution at the time of surface treatment.

The various process conditions and parameters play a role in the amount of pretreatment formed as a coating on the metal surface (typically measured as coating weight in grams per square meter). These parameters include the concentration of the constituents of the pretreating solution, the treating temperature, the contact time, the acidity of the bath, the method of application of the bath, and the characteristics of the metal being coated. In general, the coating weight increases with: An increase in concentration of certain constituents of the pretreating solution; an increase in the treating temperature; and an increase in the contact time. The selection of these parameters to achieve a given coating weight are well-known to one skilled in the art.

Some examples of ranges of these parameters are given below. Because of the interrelation of these parameters, however, it should be noted that these ranges are exemplary and a single parameter is affected by the other parameters. For example, if a higher treating temperature is used, then the contact time may be reduced in order to achieve the same coating weight for a process using a lower treating temperature and a longer contact time. In sum, the application process parameters should be set in a way such that a coating of a desired weight and of adequate quality and uniformity is applied to the metal surface. Although the desired coating weight will vary with the metal being coated, the paint or decorative coating used, and the conditions of the application (e.g., exterior versus interior), a coating weight of between about 10 to 150 mg/square foot appears to be preferable in many cases, and a coating weight of between about 150 mg/square foot to 400 mg/square foot is preferable in other cases in which a longer term of corrosion resistance is desired.

The application of the zinc phosphate solution can be carried out over a wide range of temperatures. The temperature of the bath may range from about room temperature or may be elevated, such as between about 140° F. to 160° F., although there is no reason to believe that temperatures outside of this range will prevent the composition from having the desirable effects. Generally, a slight change in the temperature will not necessitate substantial alteration of the treating time or concentrations of reactants. In deciding the temperature, the benefit of a higher coating weight or production rate due to an increased temperature must be weighed against the cost of applying heat to the bath.

The time of treatment of a metal surface with the zinc phosphate composition of the present invention need only be long enough to ensure complete wetting of the surface and can be as long as thirty minutes. Some of the various methods of application are mentioned above. In addition to including an oxidizer, the compositions used in those methods allowing for only a short contact time also preferably have a relatively high concentration to make up for the short contact time. In deciding the contact time, the benefit of a higher coating weight due to an increased contact time must be weighed against the cost of the reduced throughput due to the longer contact time.

The zinc phosphate bath may have any appropriate pH suitable for the process conditions and compatible with the equipment, as is well-known in the art.

As can be seen from the above, the concentrations of the various constituents depend upon a number of factors, and thus any particular concentration ranges are difficult to identify. Nonetheless, provided below are ranges of the weight percentages of the various constituents which may be suitable:

- the weight percentage of water added to form the mixture may range from about 8.0 to 98.0 percent, preferably between about 10.0 to 20.0 percent;
- the weight percentage of the zinc oxide added to form the mixture may range from about 1.0 to 20.0 percent, preferably between about 12.0 to 18.0 percent;
- the weight percentage of the phosphoric acid added to form the mixture may range from about 1.5 to 60.0 percent, preferably between about 35.0 to 60.0 percent;
- the weight percentage of the polyhydric compound added to form the mixture may range from about 0.01 to 1.0 percent, preferably between about 0.25 to 0.5 percent;
- the weight percentage of the metal salt added to form the mixture may range from about 0.1 to 6.0 percent, preferably between about 1.0 to 3.0 percent (metal salt in excess of 10 tends to produce a loose coating, leading to adhesion failures); and,
- the weight percentage of the oxidizer added to form the mixture may range from about 0 to 20.0 percent, preferably between about 5.0 to 20.0 percent. (The oxidizer is not included in all embodiments.)

As can be appreciated, the relative weight percentages of the constituents mixed to form the present invention are not critical. The solution formed from components mixed together with weight percentages differing from those in the exemplary embodiment may still be included within the scope of the present invention. According to a preferred composition in some case, the amounts of zinc oxide and the polyhydric compound are chosen so that, together, they are in stoichiometric excess of the phosphoric acid.

Method of Surface Treatment

The method for pretreating a metal surface, in which the present invention is used as a phosphating agent, can best be described as follows. A metal surface may be initially cleaned using any conventional means available in the art. For example, the use of an alkaline-aqueous type cleaner is common. The cleaned substrate is then rinsed to remove residues and contaminants from the cleaning step. This cleaned and rinsed metal surface may then be activated according to a preferred embodiment. In a preferred embodiment, the activation may comprise a mechanical activation accomplished by lightly abrading the cleaned metal surface. In an alternate embodiment, the activation may be done using a titanium phosphate-containing colloidal solution as is standard in the industry.

The activated metal surface is then contacted with the aqueous zinc phosphate solution of the present invention. The method for contacting the metal surface to the present invention may include spray squeegeeing, dip squeegeeing, flood squeegeeing, direct roll coating, or reverse roll coating. However, the method for applying the present solution to the metal surface is not seen to be limited to the foregoing specific methods. For example, the surface treatment may be carried out by simply immersing the metal surface within a bath containing the solution. Any application method which introduces the solution of the present invention onto the metal surface to be treated, then allows the metal surface to react with a larger portion of the solution before the excess is removed, will be suitable. Further, any suitable set of process conditions for reacting the metal surface with the solution whereby the zinc dihydrogen phosphate solution forms a coating on the metal coating, may be chosen.

When the zinc dihydrogen phosphate solution reacts with the metal surface, a coating is produced on the metal surface. This coating, which may be crystalline in some exemplary embodiments, improves adhesion of subsequently applied films or sealants by providing anchoring sites for the films or sealants. The coating also improves corrosion resistance of the metal surface. After this application process, the excess unreacted solution and excess coating may be mechanically removed by way of squeegeeing, blowing the surface dry with an "air gun", or by using other mechanical means to remove the excess solution from the surface.

After the pretreating and mechanical removal operations, the surface does not require rinsing, or extended stoving, but merely requires drying. The distinctive advantage of the present invention lies in the composition of the zinc dihydrogen phosphate solution. Because of the composition of the solution, the surface does not require any dedicated rinsing or stoving operations subsequent to the application of the phosphating solution.

Zinc dihydrogen phosphate $Zn(H_2PO_4)_2$ within the solution reacts with the metal surface and forms a coating upon the metal surface being treated. After this treatment process is complete and the coating is formed on the surface, some of the excess acidic phosphating solution remains on the surface in prior art processes. An acidic condition on the surface is undesirable, and causes problems during subsequent coating and painting operations. Hence, the use of water rinsing to remove the excess acid is required using conventional zinc phosphating processes. This rinsing step is necessitated due to excess acid and other components in conventional solutions. In the case of the prior art of Sugama et al., rinsing is not required, but the excess acid must be removed from the surface by driving the reaction between the metal surface and the excess acid by means of stoving.

In the present invention, the excess acidity is presumably consumed upon drying by reaction with the polyhydric compound which is present preferably in excess in the wet film remaining on the surface. This dried coating does not require rinsing as with the conventional systems or stoving as with Sugama et al. After mechanically removing the solution according to the present invention, and drying the substrate, the acid substantially consumed.

The polyhydric compound, which may be polymeric or molecular, quenches the acid remaining in the dried coating on the surface. Presumably, the acid is quenched by reacting with the polyhydric compound to form a polyhydric phosphate ester. It is believed that the available hydroxyl groups of the polyhydric compound react with hydrogen from the acid to form water and a polyhydric phosphate ester. For example, the following reaction between pentaerythritol (PAE) and phosphoric acid may be illustrative:

$$H_3PO_4+PAE \longleftrightarrow H_2O\uparrow+PAE\text{-phosphate ester}$$

At any rate, the excess acidity on the surface is reduced by the addition of the polyhydric compound to the solution. The free acidity of the coating is quenched. Rinsing is not required. Since the acidity is quenched, the dried, coated metal surface is in condition to be painted or further coated with an optional additional corrosion inhibiting solution such as presently employed in the industry, or may be coated with another sealant. The additional coating may then be dried and the surface painted. The final painted metal surface achieved using the present invention includes properties as are normally desired in the industry. Specifically, this final product has the desired paint adhesion qualities and corrosion resistance. Thus, a practical process is achieved for industrial production.

EXAMPLE

The following example is included to more clearly demonstrate the overall nature of the invention. This example is exemplary, not restrictive, of the invention.

Two test strips and two coils were treated with a zinc phosphate composition of the present invention. More specifically, the test strips and the coils were G-90 hot-dipped galvanized steel. In all four cases, the test strip and coil samples were first cleaned by alkaline cleaning, brushing, and rinsing in water. Then, the composition shown in Table 1 was applied to each metal sample by direct roll coating. The test strips and coils were then hot air dried and painted with a chromate primer and a polyester top coat.

TABLE I

| Example Formula I | Weight Percent |
|---|---|
| Deionized Water | 35.7 |
| Zinc Oxide | 10.5 |
| Phosphoric Acid | 42.0 |
| Cobalt Nitrate Hexa Hydrate | 1.2 |
| Hydrogen Peroxide | 9.4 |
| Pentaerythritol | 1.2 |

For comparison, standard chrome dried-in-place panels were subjected to the same cleaning, rinsing, drying, and painting steps. The standard chrome composition was an aqueous solution containing dispersed silica, chromic acid, and phosphoric acid.

All six samples were subjected to a Neutral Salt Spray test, which is well known in the art and involves exposing a painted metal sample to atomized salt spray (at 5% salt). The samples are first scored with an "X" and are analyzed for paint loss. The scribe rating rates the samples' degree of corrosion from the "X." and the field rating rates the corrosion caused by blistering across the entire metal surface, with a ten being the best rating and a one being the worst. "Maximum" ratings indicate the corrosion at the worst point and "average" ratings are averaged over the length of the scribe or surface area of the field. The results of all six samples are shown below on Table II.

TABLE II

| Ratings | Test Strip #1 | Test Strip #2 | Coil #1 | Coil #2 | Standard Piece #1 | Standard Piece #2 |
|---|---|---|---|---|---|---|
| Maximum Scribe Failure Rating: | 10 | 10 | 10 | 10 | 7 | 7 |
| Average Scribe Failure Rating: | 10 | 10 | 10 | 10 | 8.5 | 9 |
| Maximum Field Failure Rating: | 10 | 10 | 10 | 10 | 10 | 10 |
| Average Field Failure Rating: | 10 | 10 | 10 | 10 | 10 | 10 |
| 100% Humidity: | Excellent | Excellent | Excellent | Excellent | Not Tested | Not Tested |

As can be seen from the above, metal samples treated by a zinc phosphate composition of the present invention performed excellently in the Neutral Salt Spray test. It should also be noted that a 100% humidity test, which involves exposure of the panels to an environment of 105° F. and 100% humidity, was subjected to the four samples treated by the present invention, all of which revealed excellent results.

Although illustrated and described herein with reference to certain specific embodiments and example, the present invention is nevertheless not intended to be limited to the details shown. For example, other methods of applying the phosphating solution or removing it from the surface, may be used. Means other than mechanical means may be used to physically remove the solution and/or the product water, from the surface. The concentration of the various components which comprise the solution may also be varied and still remain within the scope of the present invention. The cleaning, rinsing, activating, sealing, and painting processes may also vary from those detailed above while still remaining within the scope of the present invention. The details presented are not presented to limit the scope of the present invention. Rather, the claims should be read to include various modifications within the scope and range of equivalents of the claims, without departing from the spirit of the invention.

What is claimed:

1. A method for forming a zinc phosphate coating on a metal surface comprising contacting the metal surface with an aqueous solution comprising water, a zinc source, phosphoric acid, a polyhydric compound selected from the group consisting of glycerol, diglycerol, gluconic acid, mannitol, pentaerythritol, neopentyl glycol, dihydroxycyclohexane, trihydroxycyclohexane, pyrroles, and combinations of these, and a metal salt.

2. The method of claim 1, wherein said zinc source is selected from the group consisting of zinc, zinc dihydrogen phosphate, and zinc oxide.

3. The method of claim 1, wherein at least some of said zinc oxide and at least some of said phosphoric acid react to form zinc dihydrogen phosphate.

4. The method of claim 1, wherein at least some of said polyhydric compound and at least some of said phosphoric acid react to produce a polyhydric phosphate ester as said coating is dried.

5. The method of claim 1, wherein:

the weight percentage of said water mixed to form said aqueous solution is from about 8 percent to about 98 percent;

the weight percentage of said zinc source mixed to form said aqueous solution is from about 1 percent to about 20 percent;

the weight percentage of said phosphoric acid mixed to form said aqueous solution is from about 1.5 percent to about 60 percent;

the weight percentage of said polyhydric compound mixed to form said aqueous solution is from about 0.01 percent to about 1 percent; and the weight percentage of said metal salt mixed to form said aqueous solution is from about 0.10 percent to about 6 percent.

6. The method of claim 1, wherein an oxidizer is additionally mixed in forming said aqueous solution.

7. The method of claim 1, wherein said oxidizer is hydrogen peroxide.

8. The method of claim 1, wherein said polyhydric compound is branched.

9. The method of claim 1, wherein said polyhydric compound is pentaerythritol.

* * * * *